US006390397B1

(12) United States Patent
Ko

(10) Patent No.: US 6,390,397 B1
(45) **Date of Patent: *May 21, 2002**

(54) PAPER SHREDDING DEVICE

(76) Inventor: Joseph Y. Ko, 12 Morning Dove, Laguna Niguel, CA (US) 92677

( * ) Notice: Subject to any disclaimer, the term of this patent is extended or adjusted under 35 U.S.C. 154(b) by 0 days.

This patent is subject to a terminal disclaimer.

(21) Appl. No.: 09/427,771

(22) Filed: Oct. 26, 1999

(51) Int. Cl.[7] ..... B02C 15/22

(52) U.S. Cl. ..... 241/34; 241/100; 241/224; 241/236

(58) Field of Search ..... 241/34, 100, 224, 241/236

(56) References Cited

U.S. PATENT DOCUMENTS 3,724,766 A * 4/1973 Bosland ..... 241/100
5,295,633 A * 3/1994 Kimbro et al. ..... 241/236
5,975,445 A * 11/1999 Ko ..... 241/100

* cited by examiner

*Primary Examiner*—Mark Rosenbaum
(74) *Attorney, Agent, or Firm*—Knobbe, Martens, Olson and Bear, LLP

(57) ABSTRACT

An automatic paper shredder is capable of sequentially cutting up to 20 sheets of 20-lb bond paper, up to 9 inches wide. The device has adjustable holders for attachment to conventional wastebaskets of varying shapes. A feed tray holds the stack of paper. Upon selection of either manual (ON) or automatic (AUTO) operation of the machine, a single sheet of paper is fed into the machine by a roller as are subsequent sheets, if any. With the three-way switch set to AUTO, any sheets on the tray are detected by a sensor and are automatically fed into the machine for shredding. A plug-in motor contained in the housing of the machine drives a plurality of shafts for the feed roller and knife rollers. The knife rollers are configured to either shred the paper into about ⅜-inch wide strips or to cross-cut the paper into a plurality of smaller pieces.

10 Claims, 4 Drawing Sheets

PAPER SHREDDING DEVICE

BACKGROUND OF THE INVENTION OF THE INVENTION

The present invention relates generally to paper shredding machines, and, in particular, to a paper shredding device capable of sequentially cutting up to 20 sheets of paper.

Paper shredding devices are used to aid in paper recycling or to prevent dissemination of the information on the paper. The paper shredding devices heretofore available have either been large, expensive devices for use with large quantities of paper, or smaller devices for single sheet feeding by the user. Some smaller devices allow the user to manually insert a document having up to about 8 pages, and the device is mounted to a top of a trash can. Often, the trash can must be one specially designed for secure attachment of the device.

The smaller devices typically have limited cutting ability and require manual insertion of a document into the top of the device. Thus, when these smaller devices are used in the home or office, the user is required to spend time feeding individual sheets of paper into the machine.

SUMMARY OF THE INVENTION

A paper shredding device having features of the present invention advantageously provides an automatic feed mechanism by which a stack of up to about 20 sheets of conventional, 20-lb bond paper can be shredded. Paper up to about 9 inches wide and of various lengths can be stacked onto a feed tray at a side of the housing, and the device has adjustable arms for mounting over a conventional waste receptacle. Straight cutting of the paper into strips can be performed, or cross-cutting to confetti-like pieces can be done.

In a preferred embodiment, the device comprises a housing having a feed opening and a discharge opening, with a pair of adjustable holders on opposed sides of the housing for mounting the device on a top of a waste receptacle. A feed element of the device has a tray for holding a plurality of sheets of paper and a roller. The roller captures and delivers each sheet of paper on the tray into the feed opening. A motor is contained in the housing and drives a shaft of the roller of the feed element. The motor is configured to operate from an electrical power source.

At least two knife rollers are contained in the housing and are positioned adjacent the discharge opening. These knife rollers are configured to cut each of the sheets of paper upon contact therewith, such that a plurality of pieces of the sheet of paper exit through the discharge opening and into the waste receptacle. A three-way switch is provided for selecting a desired operational condition of the device, wherein the device is operable by setting said switch 1) to ON to activate said device, 2) to AUTO such that placement of at least one sheet of paper onto the tray initiates cutting thereof, or 3) to OFF for deactivation.

The knife rollers are optionally configured to cross-cut the sheets of paper into pieces having lengths shorter than the original lengths of the sheets of paper. The device may comprise a belt drive for coupling rotation of the shaft of the feed element with rotation of the knife rollers. The device preferably comprises a sensor on the tray of the feed element for detecting the presence of at least one sheet of paper. The sensor may provide continuous feeding of up to 20 sheets of paper into the device when their presence is detected in the AUTO setting, or, alternatively, when the switch is set to ON. Preferably, the electrical power source is an AC outlet and the motor is electrically connected using a plug.

Further advantages and applications will become apparent to those skilled in the art from the following detailed description of the prefer red embodiment and the drawings referenced herein, the invention not being limited to any particular embodiment.

DETAIL DESCRIPTION OF THE PREFERRED EMBODIMENTS

Figure 1:
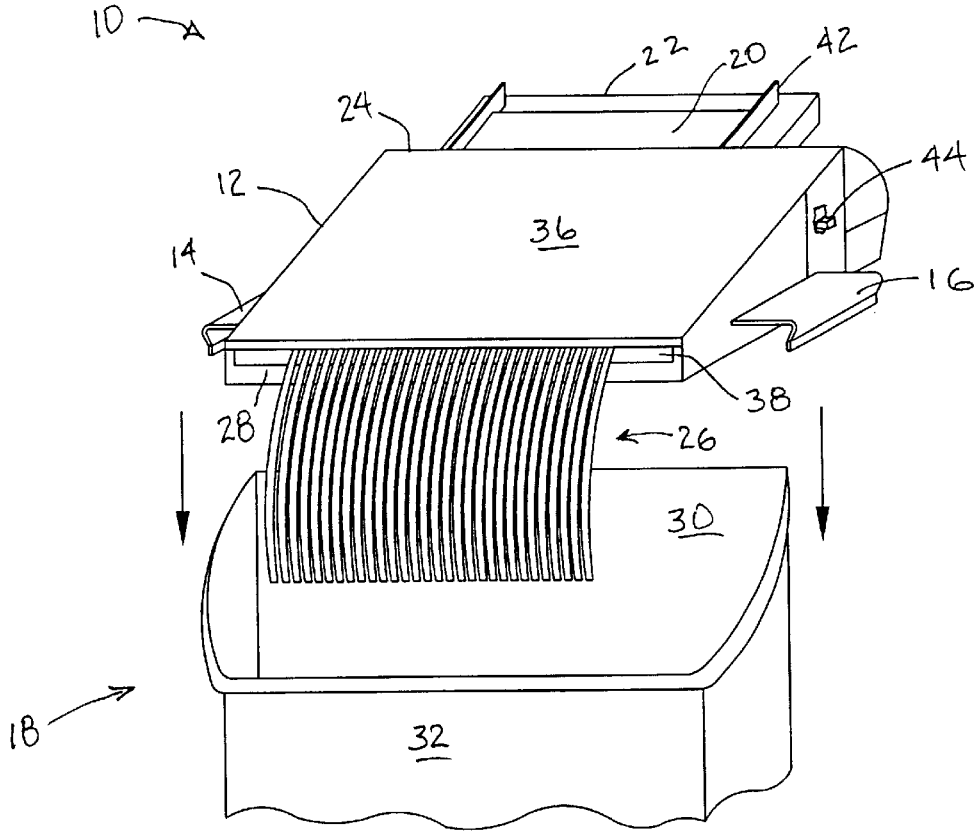
FIG. 1 shows a top, front perspective view of a device to be used with a rectangular wastebasket and having features in accordance with the present invention.

FIG. 1 shows a preferred embodiment of the paper shredding device 10 of the present invention. A housing 12 has a pair of arms 14, 16 on the left and right sides for mounting on top of a rectangular opening of a typical office trash can 18. One or more sheets of paper 20 are stacked onto a feed tray 22 at a rear 24 of the housing, and the cut or shredded paper 26 exits from a front of the housing into the trash can 18. The center of gravity of the device 10 is balanced such that the housing 12 can be appropriately mounted on the top of the trash can 18 without causing the trash can to topple over.

The housing 12 is shown as being shaped similar to a portable typewriter, or somewhat rectangular in plan view and parallelogram shaped in cross-section. However, other shapes may be used without loss of the benefits of the present invention.

The arms 14, 16 are positioned so that the rear 24 of the housing can sit atop a rear wall 30 of the trash can 18 while the front 28 of the housing is sufficiently spaced from a front wall 32 of the trash can to allow the shredded paper 26 to fall readily into the trash can 18. Alternatively, such as with a larger trash can or with a trash can having an oval or circular opening, the rear 24 of the housing is unsupported and hangs over the trash can opening.

Figure 2:
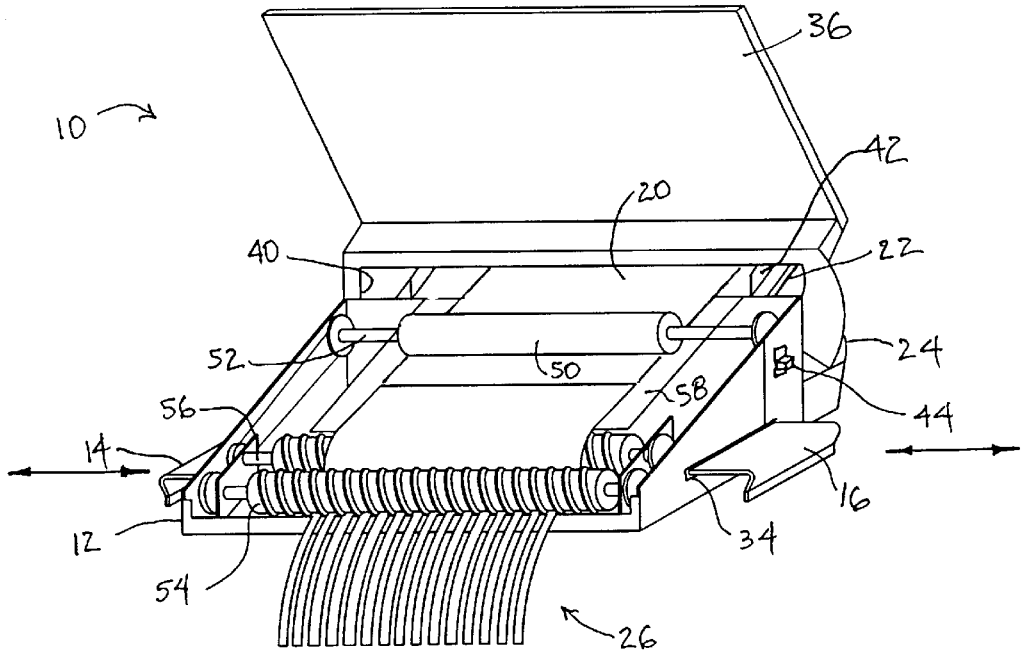
FIG. 2 shows a front perspective view of the device of FIG. 1 with its top cover open to show the path of the paper from the feed tray to the discharge opening.

As shown in FIG. 2, the arms 14, 16 preferably telescope into and out from slots 34 at lower portions of the sides of the housing 12, according to the size opening of the trash can. A cover 36 of the housing is preferably hingedly connected at the rear 24 of the device to allow access to the interior. Alternatively, the cover 36 could be hinged at the front 28, or could be attached by screws, or slidably mounted onto the housing 12 using methods known to those skilled in the art. A slot 38 extending at least about 9 inches wide, or about the length of the front wall 28 of the housing 12, is located on the front and sized to expel the shredded paper 26 therethrough. In the embodiment shown in FIGS. 1 and 2, the cover 36 forms the upper boundary of this exit slot 38.

The feed tray 22 is mounted at the rear wall 24 of the housing, adjacent a feed slot 40. The tray 22 may have tabs received into the rear wall 24 so that it is removable for shipping, or the tray 22 may be secured using screws or other fasteners. Preferably, the tray 22 is slightly tilted in use to provide a gravity-assisted feed of the paper 20 into the feed slot 40. The tray 22 should be sized to support paper having dimensions ranging from about 8½"×11" to about 8½"×14". The tray 22 preferably has adjustable guides 42 for the feeding of paper having widths ranging between about 8 to 9 inches. The slot and tray heights are sufficient to receive a stack of about 20 sheets of 20-lb bond paper. If desired, markings may be provided on the feed tray 22 and/or guides 42 to indicate the paper size and approximate height corresponding to 20 sheets of paper.

A three-way switch 44 is located at a side of the housing, although, other locations such as at the rear wall 24 may be used. The three settings for the device are OFF, ON and AUTO for deactivation, continuous operation and automatic operation, respectively. The switch 44 is operably coupled via a cable 45 to a conventional motor 46 shown in FIG. 3 and activates the feed and cutting mechanisms, as described in greater detail with reference to FIG. 4.

A sensor 48 is preferably provided at the feed slot 40 to detect the presence of at least one sheet of paper. Any conventional sensor may be used and its construction is therefore not presented in detail herein. In operation, the sensor 48 detects the presence of the edge of a sheet of paper extending into the feed slot 40. For a stack of two or more sheets of paper, the lowermost sheet is detected.

Upon detection by the sensor 48, in either the ON or AUTO mode of operation, the sheet of paper is advanced by rollers 50 of the feed mechanism into the housing 12. The one or more pairs of rollers, of which only the upper roller 50 is visible in FIG. 2, have their shafts 52 rotatably coupled to knife rollers 54 of the cutting mechanism. The shafts 52, 56 of the feed rollers 50 and knife rollers 54 are driven by the electric motor 46 using a series of gears 57.

The feed rollers 50 deliver each sheet of paper over a support 58 in the housing. A rear edge of the support 58 is adjacent the feed slot 40 and a front edge of the support provides delivery of the sheet of paper to between the knife rollers 54 for cutting.

Preferably, the motor 46 is configured to be electrically coupled to an AC outlet 47 using a cable and plug connection, wherein the cable 59 having the plug (not shown) extends from the rear 24 of the housing. In a preferred embodiment, the motor 46 operates at 115 Volts and causes rotation of the rollers 50, 54 corresponding to about 20 feet of paper being fed and shredded per minute. The motor 46 may alternatively be configured to be portably powered by batteries (not shown) contained in the housing 12 of the device.

Figure 3:
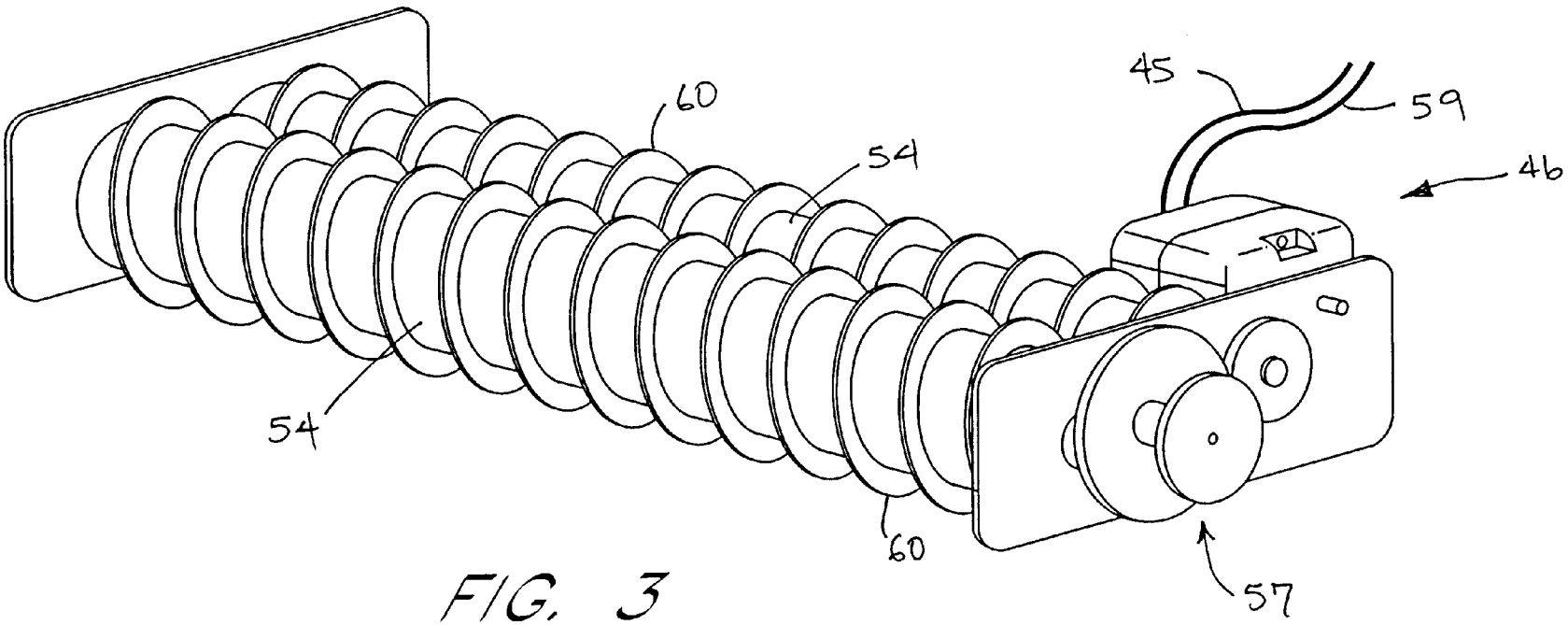
FIG. 3 shows a schematic view of the motorized drive for the feed roller and knife rollers.
Figure 5:
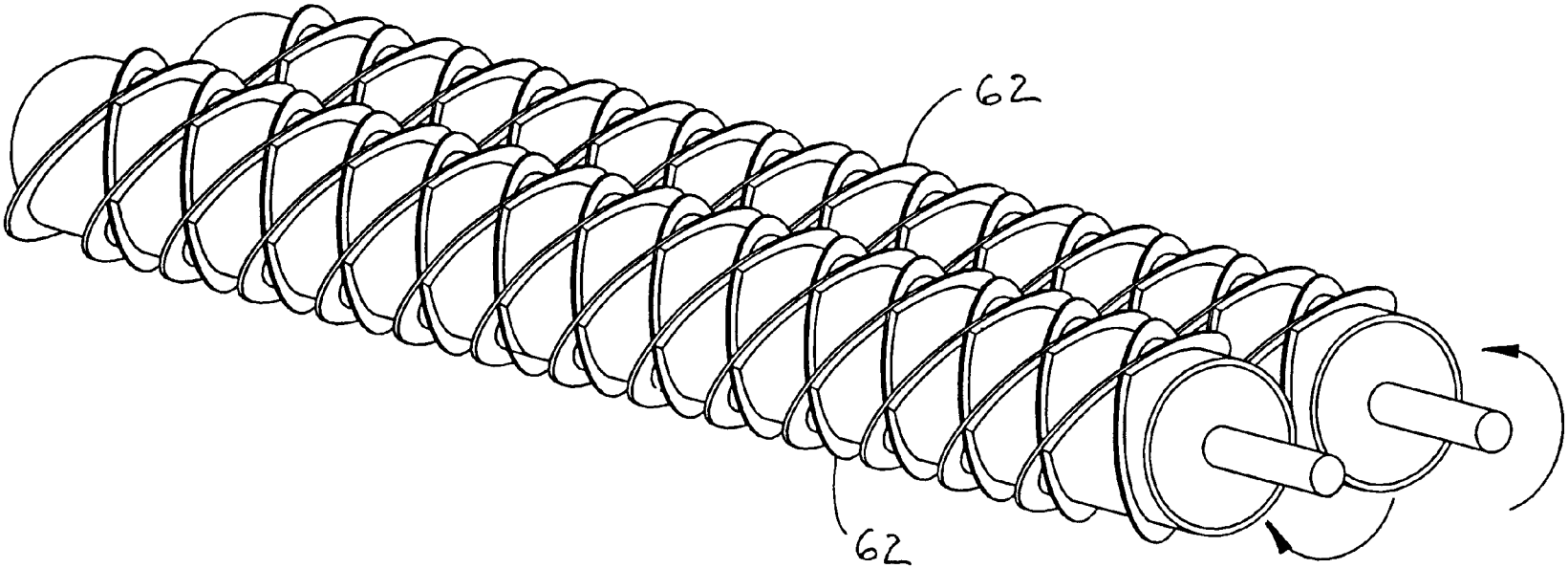
FIG. 5 shows an alternative embodiment of the knife rollers.

As shown in FIGS. 2 and 3, the knife rollers 54 may have annular knife edges 60 spaced substantially along the lengths of the rollers. This results in the paper being cut into strips having widths corresponding to the spacing of the annular edges 60, preferably about ⅜ inches wide. The length of the strips depends upon the length of the paper, or between about 11 to 14 inches long. In an alternative embodiment, knife rollers may be used which have sharpened edges 62 formed thereon in a criss-cross fashion as shown in FIG. 5, which results in cross-cutting of the paper into substantially smaller pieces similar to confetti.

The knife rollers 54 are preferably made of steel or other appropriate material to provide adequate cutting of paper including 20-lb bond type. The knife rollers 54 should be able to withstand heavy use before any sharpening or replacement of the knife rollers becomes necessary. It is preferred that the knife rollers 54 be able to cut through an occasional staple left in the stack of paper 20, which may comprise one or more stapled documents having several pages each. Although, preferably, metal and plastic paper clips and the like are removed prior to shredding of the paper by the device 10.

Figure 4:
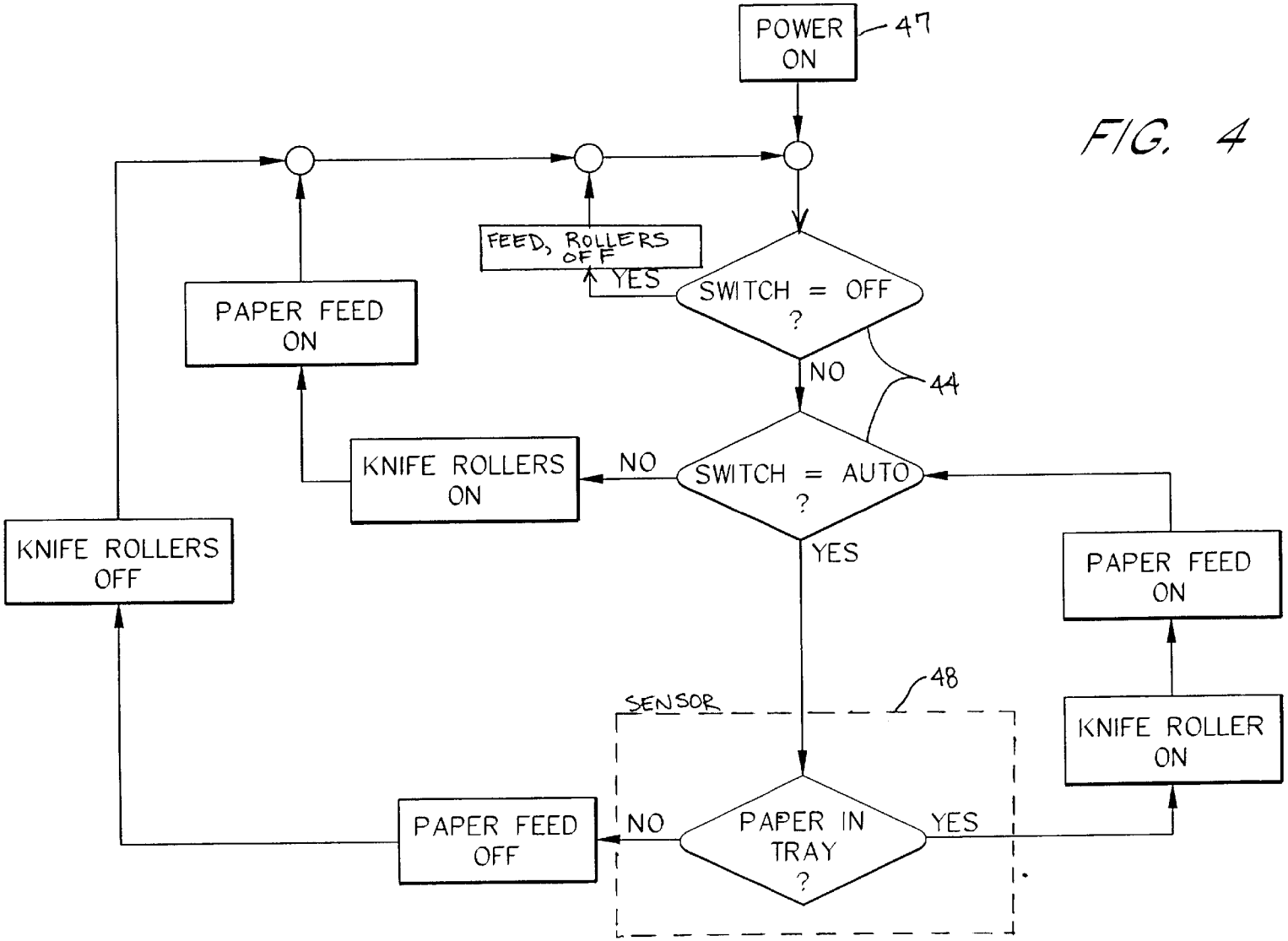
FIG. 4 shows a simplified flow chart showing the preferred operational states of the device.

Referring to FIG. 4, the various operating conditions of the device 10 are presented in a simplified flow chart. The power source 47 must first be connected, either by the device 10 being plugged into an outlet or by the use of batteries. The switch 44 must be set to either ON or AUTO for operation. For the ON setting, the feed rollers 50 are activated for delivery into the housing 12 of any sheet of paper 20 present on the feed tray 22. The sheets are sequentially fed into the knife rollers 54, which are also activated to cut the paper according to whether annular or cross-cutting edges 60, 62 are provided. This setting provides continuous feeding and cutting of papers set onto the feed tray 22, until deactivation occurs by setting the switch 44 to OFF.

For the AUTO setting, the sensor 48 detects the presence of at least one sheet of paper 20 on the feed tray 22. If paper is detected, the feed and cutting mechanisms are activated. When paper is no longer detected in the tray 22, the mechanisms are temporarily deactivated. Preferably, a short delay is provided from the time of the sensor 48 reading of the absence of paper to the deactivations of the mechanisms to allow the last sheet of paper to be completely shredded and expelled.

The embodiment described above is provided merely to illustrate the present invention. Changes and modifications may be made from the embodiment presented herein by those skilled in the art without departure from the spirit and scope of the invention, as defined by the appended claims.

What is claimed is:

1. A portable device for shredding paper adapted to be situated over a container for receiving shredded paper, comprising:

a mounting mechanism for mounting the device over the container;

a front section, a rear section, and a center of gravity such that the device is balanced over the container;

a shredding mechanism having an entrance and exit, said shredding mechanism being off-center from the center of gravity toward the front section of the device so that the exit is situated over the container; and a compact feed element comprising a tray, said tray having a leading edge positioned substantially at the entrance of the shredding mechanism and a trailing edge positioned over the rear section of the device.

2. A portable device for shredding paper adapted to be mounted to an upright support having a top and an opening in the top for receiving shredded paper, comprising:

a mounting mechanism for mounting the device to the upright support;

a shredding mechanism having an entrance and an exit wherein the exit is situated over or within the upright support; and a compact feed element comprising a tray for sequentially feeding paper into the entrance of the shredding mechanism, said tray having a leading edge positioned substantially at the entrance of the shredding mechanism, and wherein the center of gravity of the device is such that the device can be mounted to the upright support without causing the upright support to topple over.

3. The portable device of claim 2, wherein the shredding mechanism comprises at least two knife rollers configured to cut the paper upon contact therewith and discharge the paper through the exit of the shredding mechanism.

4. The portable device of claim 3, wherein the knife rollers have annular knife edges spaced substantially along the lengths of the knife rollers.

5. The portable device of claim 3, wherein the knife rollers are configured to cross-cut the paper into pieces having lengths shorter than the lengths of the paper prior to cutting.

6. The portable device of claim 2, wherein the compact feed element further comprises a feed roller, said feed roller capturing at least one sheet of paper on the tray and advancing it to the entrance of the shredding mechanism.

7. The portable device of claim 2, wherein the compact feed element further comprises a sensor for detecting the presence of at least one sheet of paper.

8. A portable device for shredding paper adapted to be mounted to a container for receiving shredded paper, comprising:

a mounting mechanism for mounting the device to the container;

dual shredding rollers mounted adjacent one another on the device, said rollers forming an entrance and an exit, said exit being situated over or within the container; and a paper feeding tray for feeding paper into the entrance of the dual shredding rollers, said tray having a leading edge positioned substantially at the entrance of the dual shredding rollers, and wherein the dual shredding rollers and paper feeding tray are counterbalanced to prevent the device from falling off of the container.

9. A portable device for shredding paper adapted to be mounted to an upright support having a top and an opening in the top for receiving shredded paper, comprising:

mounting means for mounting the device to the upright support;

shredding means for shredding the paper; and feed element means for sequentially feeding paper into the entrance of the shredding means, and wherein the center of gravity of the device is such that the device can be mounted to the upright support without causing the upright support to topple over.

10. The portable device of claim 9, wherein the feed element means further comprises sensor means for detecting the presence of at least one sheet of paper.

* * * * *